United States Patent [19]

Ottolini

[11] 4,416,076

[45] Nov. 22, 1983

[54] DEVICE FOR RETAINING CARTRIDGES IN THE MAGAZINE OF A SEMI-AUTOMATIC SHOTGUN DURING A REPLACEMENT OF THE CARTRIDGE IN THE FIRING CHAMBER

[75] Inventor: Leonardo Ottolini, Brescia, Italy

[73] Assignee: Luigi Franchi S.p.A., Fornaci, Italy

[21] Appl. No.: 335,032

[22] Filed: Dec. 28, 1981

[30] Foreign Application Priority Data

Jan. 23, 1981 [IT] Italy ..... 20556 E/81

[51] Int. Cl.[3] ..... F41C 25/08

[52] U.S. Cl. ..... 42/17

[58] Field of Search ..... 42/17, 21

[56] References Cited

U.S. PATENT DOCUMENTS 2,562,037 7/1951 Humestor ..... 42/17

*Primary Examiner*—Charles T. Jordan
*Assistant Examiner*—Ted L. Parr
*Attorney, Agent, or Firm*—Sughrue, Mion, Zinn, Macpeak and Seas

[57] ABSTRACT

A device for retaining cartridges in a tubular magazine of a semi-automatic shotgun when the cartridge in the firing chamber is being replaced, comprising a spring-loaded catch lever which is pivoted to the gun about a transverse axis, so as to be angularly displaceable between an inoperative position allowing the discharge of cartridges from the magazine, and an operative position blocking the discharge of cartridges from the magazine. The lever is displaced manually into its operative position and is held in this position by the action of the magazine spring until the gun is fired, whereupon the recoil causes the automatic release of the lever to its inoperative position.

2 Claims, 2 Drawing Figures

Figure 1:
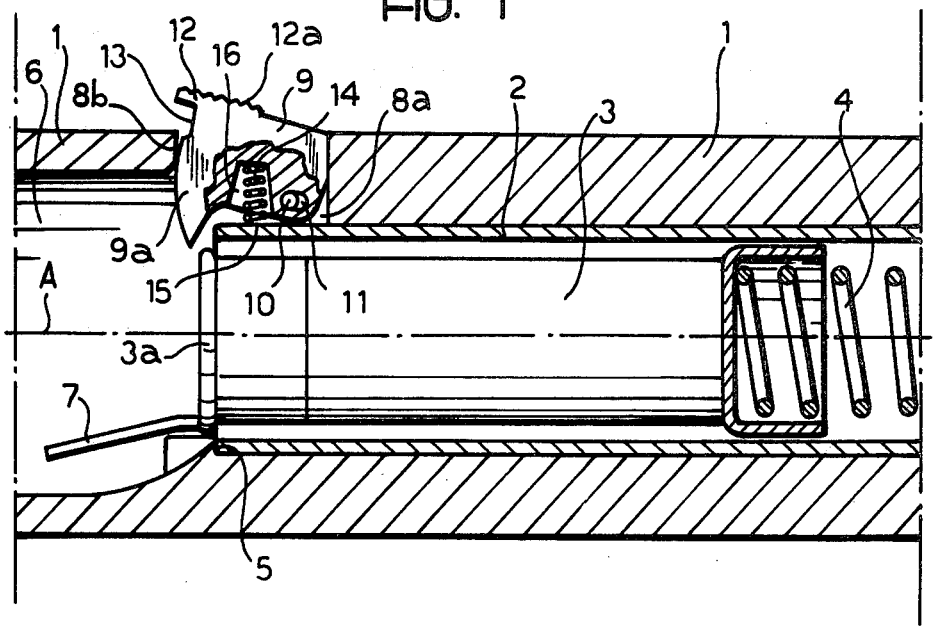

DEVICE FOR RETAINING CARTRIDGES IN THE MAGAZINE OF A SEMI-AUTOMATIC SHOTGUN DURING A REPLACEMENT OF THE CARTRIDGE IN THE FIRING CHAMBER

This invention relates to a device for retaining cartridges in the magazine of a semi-automatic shotgun during replacement of the cartridge in the firing chamber of the gun. More particularly, this invention is concerned with a device of the aforesaid type for use in a tubular cartridge magazine which extends parallel to, and below, the barrel of the gun.

It is known that, during a hunting party, it quite frequently proves necessary to replace the cartridge in the firing chamber by another with different characteristics. In order to effect this replacement at presemt, it is necessary to withdraw the breech-block of the gun manually, simultaneously ejecting the cartridge from the firing chamber while preventing a cartridge from leaving the magazine, and then inserting the required cartridge into the firing chamber through the aperture made available by the breech-block being maintained in its withdrawn position.

These operations have the recognised disadvantage of being particularly laborious, if not difficult, and of requiring a rather long time to perform. In order to reduce these disadvantages, it has been proposed to provide the shotgun with a lever which can be positioned to close, at least partially, the open end of the magazine so as to prevent cartridges from leaving the magazine. As regards this proposal, however, there is a disadvantage which is linked to the fact that such a lever is operated manually. When, as happens quite frequently, the user of the gun "forgets" to disengage the lever from the position in which it closes the open end of the magazine, after having fired a cartridge, the shotgun is left inadvertently in a disarmed condition, that is, with an empty firing chamber.

The main object of this invention therefore, is to provide a semi-automatic shotgun with a device which, while being engaged manually to prevent the cartridges from leaving the magazine and allowing the replacement of the cartridge in the firing chamber with a new cartridge, is disengaged automatically when the new cartridge has in its turn been fired, restoring the shotgun automatically for the immediate use of the cartridges in the magazine.

The present invention achieves this object by providing a device which comprises:

a fixed pin extending perpendicular to the longitudinal axis of the magazine;

a lever having a portion accessible from outside the gun, and a hooked portion within the gun;

means for pivotally coupling the lever to the pin, said coupling being loose in the direction of the longitudinal axis of the magazine, whereby the lever is angularly displaceable about the pin from a first position, in which said hooked portion is spaced from the open end of the magazine, to a second position, in which said hooked portion extends transverse the open end of the magazine, so as to constitute a stop for the cartridges therein;

a spring for resisting displacement of the lever from the first position to the second position, and means for releasable locking of the lever in the second position.

Figure 2:
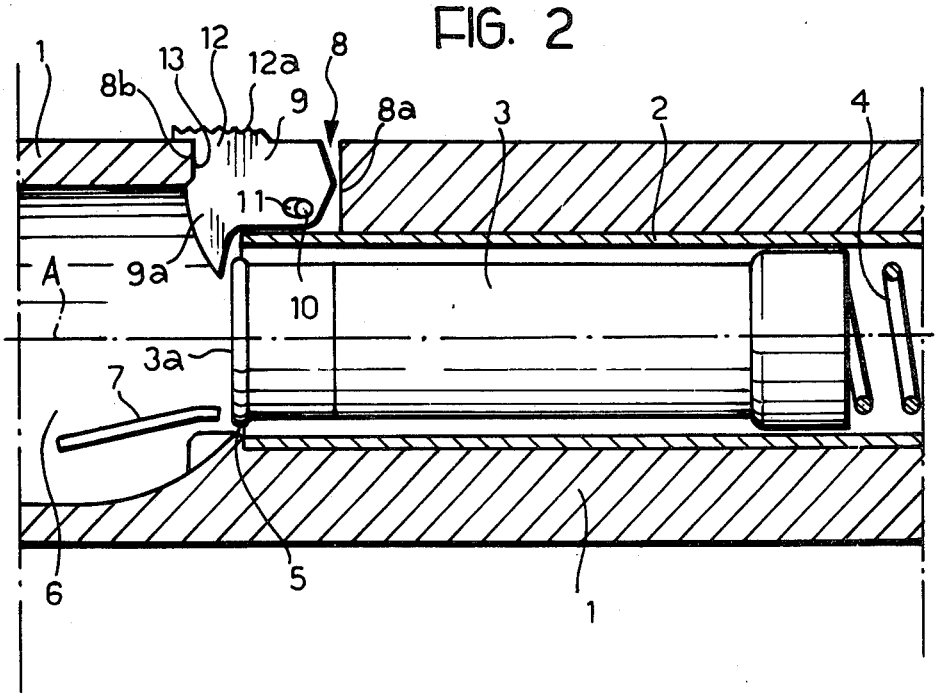

One embodiment of the present invention will now be described in more detail by way of example, with reference to the appended drawings in which:

FIG. 1 is a schematic longitudinal section of a portion of semi-automatic shotgun and its cartridge magazine, showing a device according to the invention in a first position of use, and FIG. 2 is a view similar to FIG. 1 showing the device in a second position of use.

With reference to the drawings, there is shown a part of the body 1 of a semi-automatic shotgun with a tubular magazine 2 for cartridges 2, which extends parallel to and below the barrel (not shown) of the gun. The longitudinal axis of the magazine 2 is indicated A.

The cartridges 2 are disposed in a mutually head-to-tail arrangement in the magazine 2, and are thrust axially towards the open end 5 of the magazine by a spring 4. The magazine 2 communicates, through this open end 5, with a space 6 in which the trigger mechanisms and reloading mechanisms of the semi-automatic gun are usually located, these mechanisms not being shown since they are entirely conventional. Conventionally, there is a conveyor (also not shown) between the mechanisms, for transferring a cartridge 3 from the magazine 2 to the firing chamber (not shown) of the gun, and a stop 7 which retains the cartridges 3 in the magazine between one firing and the next.

An aperture 8 with predetermined transverse dimensions is formed in the body 1, through which a limited part of the magazine 2, including its open end 5, and the space 6 are accessible. The front and rear transverse walls of the aperture 8 are indicated 8*a* and 8*b* respectively.

In this aperture 8, the body 1 of the gun supports a pin 10 which extends perpendicular to the axis A of the magazine. A plate-like lever 9, which has an essentially hook-shaped portion 9*a*, is pivoted to the pin 10 about which it is angularly displaceable within the aperture 8. In particular, the coupling between the lever 9 and the pin 10 is effected by the engagement of the pin in an eyelet hole 11 which is formed in the plate-like lever 9 and is elongate in a direction parallel to the axis A of the magazine 2. Thus, the coupling is loose in the direction of the axis A and the plate-like lever 9 is susceptible to small displacements in this direction within the aperture 8. The lever 9 is angularly displaceable about the pin 10 from a first position (FIG. 1), in which its hook portion 9*a* is spaced from the open end 5 of the magazine 2, to a second position (FIG. 2), in which the hook portion extends transverse the open end 5 of the magazine, so as to form a stop for the cartridges 3 contained therein. Naturally, the dimensions of the lever 9, the length of the eyelet hole 11, the position of the pin 10 in the aperture 8, and the length and shape of the hook portion 9*a* are chosen so as to achieve the aforesaid object. It should be noted that, when the lever 9 is in the second position specified above, its portion 9*a* bears against the base 3*a* of the cartridge 3 facing the space 6, and that this cartridge is urged by the spring 4 against the hook portion 9*a*.

The rear side of the lever 9 is formed with a shaped recess 13 for releasable engagement with the matching profile of the rear transverse wall 8*b* of the aperture 8, in a manner which will be further described below.

A portion of the lever 9 between the hook portion 9*a* and the eyelet hole 11 is formed with a blind hole 16 which is open towards the magazine 2. A spring 14 is located in this blind hole, which bears at one end against the bottom of the hole and at the other end is engaged on a spring guide 15 fixed to the magazine 2.

The side 12 of the lever 9 which is accessible from outside the gun is, to advantage, provided with knurling 12*a* to facilitate the manual operation of the lever 9.

Under the normal conditions of use of a semi-automatic shotgun provided with the device described above, the lever 9 is maintained in the position illustrated in FIG. 1. In this position, the hook portion 9*a* of the lever is spaced from the open end 5 of the magazine 2 and does not interfere with the cartridges 3. Consequently, the cartridges may be transferred from the magazine 2 to the conveyor (not shown), and from the conveyor to the firing chamber, in the usual and conventional manner.

When it is required to replace the cartridge in the firing chamber by another cartridge with different characteristics, the user must proceed in the following manner. By pressing on the knurled portion 12*a* of the lever 9 and overcoming the force of the spring 14, he causes the angular displacement of the lever about the pin 10 until the hook portion 9*a* of the lever comes into contact with the base 3*a* of the cartridge 3 facing the space 6. Once this contact has been made, the user must increase the pressure on the lever 9 to overcome the force of the spring 4 which acts axially on the cartridge, so that the cartridge (or possibly the plurality of cartridges present in the magazine 2) is pushed back a short distance into the magazine itself. The angular displacement of the lever 9 is completed when the recess 13 of the lever has engaged the profile rear wall 8*b* of the aperture 8, and when the upper side 12 of the lever bears against the body. At this point, the user ceases his manual action on the lever 9 so that the action of the spring 4, through the engagement between the base 3*a* of the cartridge 3 and the hook portion 9*a* of the lever, becomes the prevailing bias on the lever. Under this thrust, the lever is displaced towards the wall 8*b*, this displacement being allowed by the loose coupling between the eyelet hole 11 and the pin 10. This displacement causes the engagement between the recess 13 and the rear wall 8*b* of the aperture 8 to become stable, the engagement constituting essentially the means for locking the lever 9 in the position shown in FIG. 2. Being locked in this way, the lever presents the cartridges 3 from leaving the magazine 2. Under these conditions, the user can now withdraw the breech-block of the gun, eject the cartridge from the firing chamber, and insert a new cartridge into the firing chamber which is now empty. Once the breech-block has been released, the gun is ready for the firing of the new cartridge.

When such firing occurs, the cartridge or cartridges 3 move back into the magazine 2 under the effect of the recoil, overcoming the thrust of the spring 4, while the lever 9 is released from engagement with the cartridges and is displaced, also under the recoil effect, towards the front wall 8*a* of the aperture 8. With this displacement, which is allowed by the loose coupling between the eyelet hole 11 and the pin 10, the recess 13 is disengaged from the rear wall 8*b* of the aperture 8. The action of the spring 14 now becomes the prevailing bias on the lever 9, whereby the lever is "automatically" displaced angularly about the pin 10 to take up the position shown in FIG. 1, in which the hook portion 9*a* is again spaced from the open end 5 of the magazine 2 and does not interfere with the cartridges 3. Thus, the gun is again made ready for use of these cartridges.

The automatic disengagement of the device described above constitutes the main advantage of the invention, to which should be added those advantages constituted by the simple construction, and the rapid, practical, and safe operation.

I claim:

1. In a semi-automatic shotgun including an elongate tubular cartridge magazine with an open end through which cartridges are discharged to the firing chamber of the shotgun, a device for retaining the cartridges in the magazine during replacement of a cartridge in the firing chamber, comprising:

a fixed pin extending perpendicular to the longitudinal axis of the magazine;

a lever having a portion accessible from outside the gun, and a hooked portion within the gun;

means for pivotally coupling the lever to the pin, said coupling being loose in the direction of the longitudinal axis of the magazine, whereby the lever is angularly displaceable about the pin from a first position, in which said hooked portion is spaced from the open end of the magazine, to a second position, in which said hooked portion extends transverse the open end of the magazine, so as to constitute a stop for the cartridges therein;

a spring for resisting displacement of the lever from the first position to the second position, and means for releasable locking of the lever in the second position.

2. A device as defined in claim 1, wherein said means for coupling the lever to the pin comprise a hole defined by the lever, said hole receiving the pin and being formed so as to be elongate substantially parallel to the axial direction of the magazine when the lever is in the second position.

* * * * *